United States Patent [19]

McNair et al.

[11] Patent Number: 4,520,436

[45] Date of Patent: May 28, 1985

[54] LAMP APPARATUS

[75] Inventors: Rhett McNair, Anaheim; James Helling, Newport Beach, both of Calif.

[73] Assignee: NRG Inc. MN, Edina, Minn.

[21] Appl. No.: 479,059

[22] Filed: Mar. 25, 1983

[51] Int. Cl.[3] ..... F21S 1/02; F21V 21/04

[52] U.S. Cl. ..... 362/366; 313/113; 313/493; 362/147; 362/216; 362/220; 362/223; 362/225; 362/236; 362/260; 362/311

[58] Field of Search ..... 362/145, 147–150, 362/216, 217, 218, 219, 220, 221, 222, 223, 224, 225, 235, 236, 237, 240, 247, 249, 260, 311, 364, 365, 366, 255, 296, 306, 307, 310, 377, 378; 313/53, 113, 493; 339/50 R, 51, 144 T, 145 T, 146, 154 L, 155 L

[56] References Cited

U.S. PATENT DOCUMENTS

| | | | |
|---|---|---|---|
| 1,844,639 | 2/1932 | Crumpton | 362/148 |
| 2,022,222 | 11/1935 | Sullivan | 362/364 |
| 2,211,258 | 8/1940 | Delfel | 362/235 |
| 2,330,935 | 10/1943 | Tuck | 362/147 |
| 2,878,372 | 3/1959 | Fry | 362/216 |
| 2,998,511 | 8/1961 | Chan | 362/147 |
| 3,268,721 | 8/1966 | Dworkin et al. | 362/364 |
| 3,302,019 | 1/1967 | Menzin | 362/364 X |
| 3,375,368 | 3/1968 | Dorsky | 362/365 X |
| 3,518,420 | 6/1970 | Kripp | 362/365 X |
| 3,660,651 | 5/1972 | Miles | 362/364 X |
| 3,742,208 | 6/1973 | Mills | 362/216 |
| 3,767,913 | 10/1973 | Trevithick | 362/378 |
| 3,801,815 | 4/1974 | Docimo | 362/364 X |
| 3,860,829 | 1/1975 | Fabbri | 362/148 X |
| 4,070,568 | 1/1978 | Gala | 362/311 |
| 4,086,480 | 4/1978 | Lahm | 362/148 |
| 4,232,361 | 11/1980 | Kelsall | 362/36 A |
| 4,300,073 | 11/1981 | Skwirut et al. | 313/493 X |
| 4,313,154 | 1/1982 | Capostagno et al. | 362/365 |
| 4,318,160 | 3/1982 | Dooley et al. | 362/260 X |
| 4,336,575 | 6/1982 | Gilman | 362/147 |
| 4,347,460 | 8/1982 | Latassa et al. | 313/493 X |
| 4,389,595 | 6/1983 | Kamei et al. | 313/493 X |

*Primary Examiner*—David H. Brown
*Assistant Examiner*—John E. Griffiths
*Attorney, Agent, or Firm*—James Creighton Wray

[57] ABSTRACT

Ceiling lights have recessed cans with sockets mounted centrally on a resilient, usually cantilevered, support. A lamp with an integrally connected reflector and external trim ring are connected to the socket. The resilient support pulls the trim ring up against an area of the ceiling surrounding the recessed can, causing the trim ring to act as a self-leveling device for the lamp, while functioning in the manner as a suitable trim for covering the unsightly hole in the ceiling which accommodates the recessed can or fixture. This arrangement allows the near-maximum use of the diametrical width of the opening provided by the recessed fixture as a means of projecting more usable light downward.

20 Claims, 5 Drawing Figures

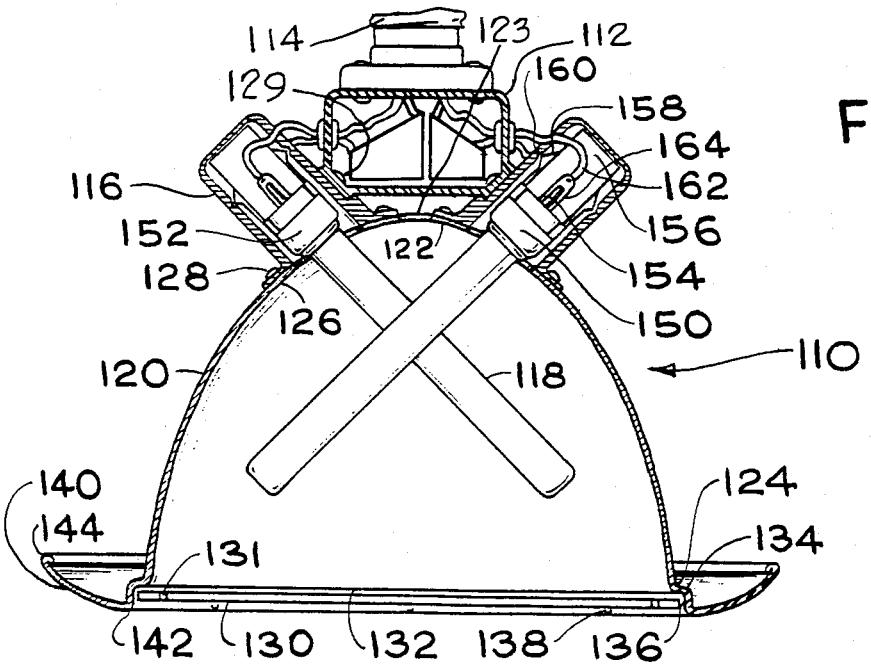
FIG. 4
FIG. 5
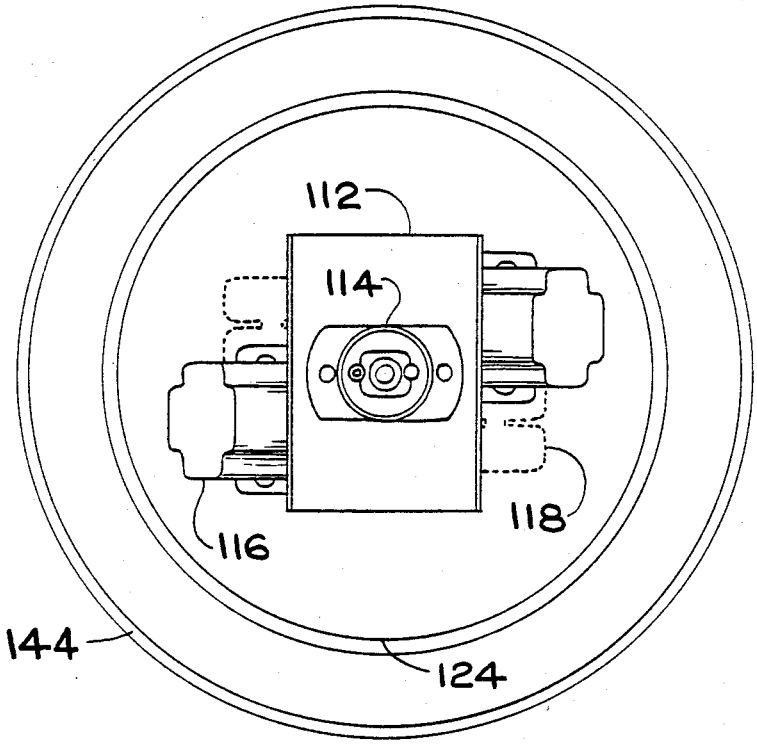

LAMP APPARATUS

BACKGROUND OF THE INVENTION

Recessed lighting fixtures are well known. Usually, the recessed "cans" are fitted within circular openings cut in ceilings. The recessed fixtures have cylinderical walls, usually closed at upper ends by covers. An L-shaped bracket has a downward, vertical leg which is connected with a screw and wing nut to a slot in a cylindrical wall of the can so that the bracket may be adjusted vertically. The horizontal leg supports a socket which has electrical connectors leading to a junction box in a conventional manner. A standard reflector lamp with a threaded lamp base is screwed into the socket. The exposed end of each recessed can and a surrounding area of a ceiling is covered by a trim ring, which is supported by tension springs with hooks connected to the trim ring and to slots in the cylindrical wall of the can.

In some situations, the trim ring must be removed before replacing or inserting the reflector lamps. Pulling downward on the trim rings and laterally displacing the trim rings or unhooking the concealed springs is a difficult and time-consuming task. Sometimes, trim rings are not inserted or are not replaced or become lost, leaving a fixture opening which is unsightly upon close inspection. The trim rings and their connections obscure part of the fitting, reducing the quantity or angle of light which may be emitted. The interior of the cans becomes heated, promoting deterioration of the wiring and sockets, and the connections between the lamp base and socket, and the trim ring aids in the retention of heat within the fixture.

Conventional recessed fittings mount reflector bulbs at varied angles. Because the socket is mounted on a cantilevered arm, and because that arm may become bent inadvertently, the reflector lamp mounted in the socket on a bent arm may be misaligned with the fixture. Light from the lamp may be misdirected, as upon leaving the fixture, or light may be partially directed onto the trim ring and reflected back into the fixture, with attendent illumination loss.

SUMMARY OF THE INVENTION

The present invention provides a trim ring integrally connected to a reflector which is connected to a lamp base for use in recessed "can" lighting fixtures.

Using the present invention, the maximum area of the opening of the recessed fixture is used for conduction of light from the fixture.

The reflector with the integral, radially extending trim ring at its large end is connected to a lamp base which is supported in the socket provided in the recessed fixture. The socket is mounted on a resilient support, and the resilient support draws the trim ring against the area of the ceiling surrounding the opening of the recessed fixture when the lamp base is connected to the socket.

In the preferred embodiment, the socket is a female threaded screw socket. The position of the socket is adjusted within the recessed fixture so that, when the threads of the lamp base are started in the socket, the trim ring is close to the ceiling. This ensures sufficient resiliency so that, as the lamp base is screwed into the socket, the socket support is resiliently stressed to maintain the trim ring against the ceiling.

When it is desired to remove the lamp, fingernails are inserted between the trim ring and the ceiling, and the trim ring is turned, turning the reflector and lamp base and withdrawing the lamp base from the socket.

In the preferred embodiment, the socket support is vertically adjusted by loosening and then tightening a wing nut which secures the support to a vertical wall of the recessed fixture. Alternatively, a fixed, resilient support may be bent beyond its elastic limit to a position where the threads on the lamp base start in the threads on the socket, whereupon further turning of the lamp base in the socket moves the support within its elastic limits to draw the lamp base, reflector and trim ring upward with the trim ring urged against the ceiling.

In a preferred embodiment of the invention, the lamp base connector is a threaded connector. The threaded connector is connected to a body of the lamp, and a light source is connected to the body. A reflector is externally connected to a body of the lamp, and a reflector has a small end which is connected to the body, a tapered or elliptical wall which opens outwardly and downwardly from the small end and terminates in a larger end and a trim ring which is integrally connected to the larger end and extends generally radially therefrom. In the preferred embodiment, the trim ring extends generally radially outwardly and rearwardly so that the outer edge of the trim ring lies against the ceiling. The outer end of the reflector has a means for receiving a lens, in a preferred form of the invention.

While the lamp functions with or without a lens, a preferred form has a lens, preferably a fresnel lens which tends to direct or to redirect the light or which tends to focus the light or widen the beam as is desirable. The lens may be secured to either the reflector or trim ring. The lens may be mounted in any position within the reflector. Preferably, the lens is mounted adjacent the larger end of the reflector near the trim ring. Any suitable mounting means may be provided for the lens. For example, the lens may be bonded or fused on the reflector, or the lens may have projections which fit into slots or openings in the reflector. In one preferred embodiment of the mounting means, a recessed wall extends radially outward from a larger end of the reflector, and a second recessed wall extends axially from an outer extremity of the radially extending wall. A plurality of inwardly extending bumps or detents on the axial wall remote from the radial wall hold a disk-shaped lens in the recess between the detents and the axial wall. In that embodiment, the trim ring curves outwardly and rearwardly from the outer extremity of the axial wall to an edge which abuts the ceiling.

While any lamp is suitable for use with the present invention, it is preferred to use a low-wattage, high-lumen output lamp.

A gaseous discharge lamp or a lamp in which electricity flows through charged gas particles to cause the gas or a coating on an envelope to glow is particularly suitable. Particularly suited are neon lamps and fluorescent lamps, as well as other lamps.

A particularly suitable lamp is a fluorescent lamp which has a ballast in a body connected to a fitted lamp base and a light-emitting tube connected to the ballast. In that preferred embodiment, a cone-shaped reflector has a small end connected to the body of the lamp and a larger end which is slightly smaller than the open end of a recessed fixture. A trim ring is integrally connected to the larger end and extends radially outward for overlying the open end of the recessed fixture and a surrounding area of the ceiling. Any reflector shape or material is suitable. In a preferred embodiment, the reflector has a metallic wall with an elliptical shape.

In one embodiment of the invention, a cup-shaped polycarbonate diffuser is removed from a lamp which has a re-entrantly bent fluorescent tube supported on a ballast-enclosing body with a screw-in lamp base. The particular lamp produces 1,100 lumens of light, which is approximately equal to the output of a 75-watt incandescent lamp, at a color temperature of 2,900° Kelvin, which is approximately the same color as light from an incandescent bulb. The light source is a double-bent, fluorescent tube which is driven by an electronic circuit contained within the base of the lamp. After the polycarbonate diffuser is removed, it is replaced by inserting the lamp in a reflector and pressing the small end of the reflector over the body which contains the electronic circuit. The reflector is designed to project the light downward with an approximately 45° beam spread. That is accomplished by using an elliptical cone reflector to direct the light rays into a clear, fresnel lens, which redirects the light rays into an approximately 45° spread.

By so doing, there is approximately the foot candle level and distribution of a 75-watt reflector floodlight, such as is commonly used in recessed, ceiling light fixtures in restaurants, building lobbies, corridors, and in retail stores, as well as in other common, public areas. The present apparatus closely approximates the quality of light from commonly used sources and does so with approximately eighteen watts of electricity as opposed to the common 75-watt usage.

The combined trim ring and reflector of the present invention act as self levelers and work in conjunction with a socket and its support to become a spring means which holds the fixture tightly against the ceiling.

The present reflector-trim ring combination saves the cost usually associated with the trim ring, currently approximately $4.00, and eliminates a common nuisance problem, which is the misplacement or loss of the trim ring during maintenance of a fixture.

The standard recessed fixture consists of a steel housing which is provided with a medium-base socket suspended from a thin, steel plate, which is bent at right angles, and which is attached to a side wall of the housing by a bolt and wing nut. The steel plate and housing are both slotted so that the height of the socket may be adjusted. Conventionally, a trim plate is used to cover the rough-cut ceiling hole. The conventional trim ring is fastened to the ceiling by two springs attached between the trim plate and slots in the side wall of the steel housing. A standard reflector lamp is screwed into the socket.

To retrofit the present unit into the existing fixture, the reflector lamp and the trim plate are removed. The socket height is adjusted so that the base of the present lamp barely starts in the threads of the socket. Grasping the built-in trim ring, the lamp is turned until electrical contact lights the lamp. The natural spring tension of the bracket pulls the unit flush and level to the ceiling. To remove the lamp, it is easy to pull the trim ring downward using the fingernails to start and then continuing to turn the trim ring until the trim ring is unscrewed from the socket.

The present apparatus allows the use of almost the full width of the opening for the fresnel lens. This is important from an efficiency standpoint when dealing with a large light source.

It is calculated that, at current rates for electricity, savings of $60 per year per socket may be realized in electrical power, lamp replacements costs and air conditioning reduction. Considering a kilowatt-hour rate of about 10 cents and 20 hours per day of lamp usage, approximately $60/year/socket is saved.

An object of the invention is to provide a lamp apparatus which has a lamp base and a light source connected to the lamp base and a reflector and integrally connected trim ring connected to the lamp base so that the entire trim ring and reflector and light source and lamp base and any auxiliary electronic equipment may be supported by a resiliently mounted socket in a recessed fixture.

These and other objects and features of the invention are apparent in the disclosure which includes the above and ongoing description and claims and the drawings.

BRIEF DESCRIPTION OF THE DRAWINGS

FIG. 4 shows a second preferred form of the invention.

FIG. 5 shows a top view of FIG. 4.

DETAILED DESCRIPTION OF THE DRAWINGS

Figure 1:
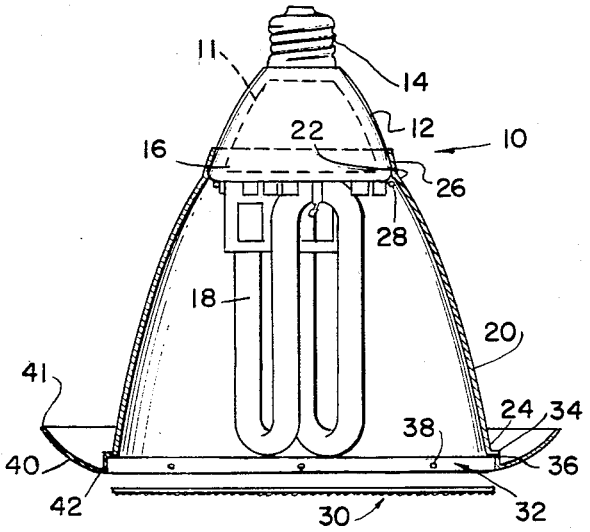
FIG. 1 is a elevational view, partly in section, showing one preferred form of the present invention.

Referring to FIG. 1, one preferred embodiment of a lamp apparatus is generally indicated by the numeral 10. Lamp 10 has a housing body 12 which houses an electronic circuit which includes a ballast 11. A conventional, screw-threaded, lamp base socket screw connector 14 is connected to one end of the housing 12.

The end portion 16 of the housing body 12 which is remote from lamp base 14 supports a lamp source 18, which, in this case, is a double-bent, fluorescent lamp.

A reflector has a cone 20 with a smaller end 22 and a larger end 24. An inward curved axial extension 26 on the smaller end 22 fits tightly over end portion 16 of body 12. Inwardly depressed beads or detents 28 capture the end portion 16 of body 12 when the body is pushed into the reflector 20 beyond the detents 28 with a snap action.

A disk-shaped, fresnel, lens 30 is received within a lens-mounting means, which includes a stepped recess 32 for retaining the lens formed at larger end 24 of reflector 20. Recess 32 has a radially extending wall shoulder 34 and an axially extending wall 36. Inward bent beads or detents 38 hold lens 30 against radial wall 34 when the prismatic lens 30 is pushed inward past the detents 38.

A trim ring 40 has an inner end 42 which is connected to the recess 32, which forms part of the outer end of the reflector 20. In the preferred embodiment, trim ring 40 extends outwardly and rearwardly to an edge 41 which abuts the ceiling around a fixture in which lamp 10 is mounted.

Figure 2:
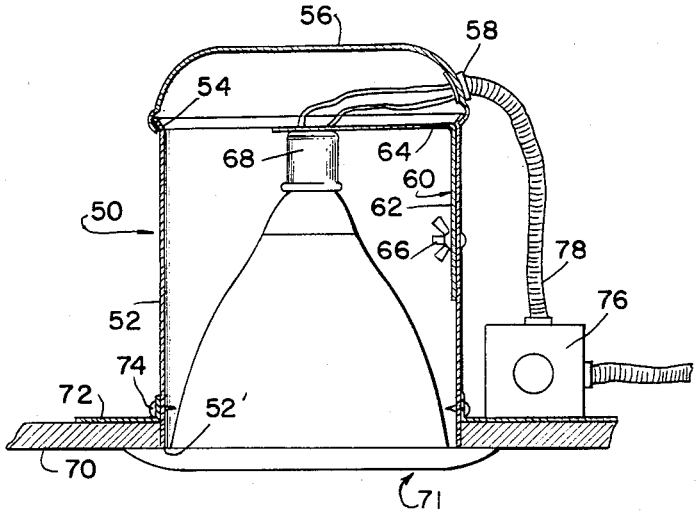
FIG. 2 shows the lamp apparatus of FIG. 1 mounted in a recessed, ceiling fixture.

As shown in FIG. 2, lamp 10 is mounted in a recessed ceiling fixture 50. Fixture 50, also called a recessed can lamp mount, has a cylindrical wall 52 with an open outer end 52'. Inner end 54 is supplied with a closure 56. Fitting 58 provides openings for conventional electrical wiring. A resilient support 60 comprises a strap which is bent with substantially a right angle to form vertical leg 62 and horizontal leg 64. A screw and wing nut 66 slide in complementary slots in vertical leg 62 and cylindrical wall 52 to adjust the desired position of the horizontal leg 64. Conventional socket 68 is mounted on a distal end of the leg 64. Lamp 10 is screwed into the socket so that leg 64 is resiliently bent downward by insertion of the lamp so that upward tension tends to pull the trim ring 40 against the portion of the ceiling 70 which surrounds the fixture 50.

Fixture 50 is supported on ceiling area 70 which surrounds lamp area 71 by a circular plate or radial straps 72 which are connected to wall 52 by self-threading screws 74. A junction box 76 is provided adjacent the fixture 50, and conduit 78 leads from the junction box to the fitting 58 on the fixture.

Figure 3:
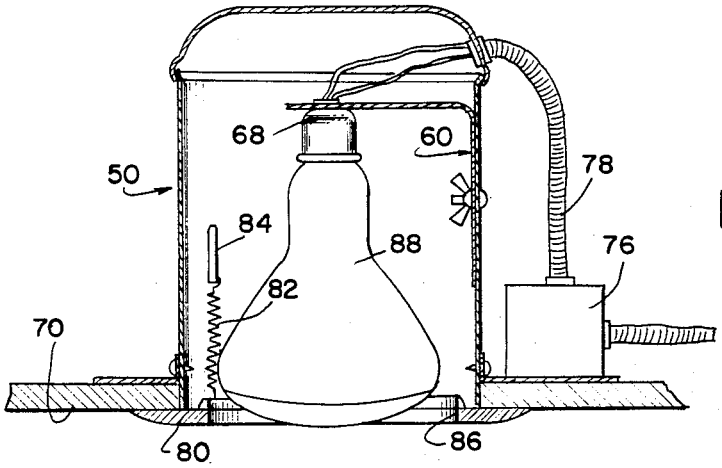
FIG. 3 PRIOR ART
FIG. 3 shows a recessed, ceiling fixture, reflector lamp and trim ring of the prior art.

As shown in FIG. 3, in a conventional fixture of the prior art, trim ring 80 is supported on two springs 82 which are connected to slots 84 in the fixture. The opening 86 of the trim ring 80 is spaced inward from the wall of the fixture 50. A conventional reflector lamp 88 is mounted in the socket 68.

In the preferred form of the lamp shown in FIG. 4, two commercially available lamps are mounted as a light source in a single reflector with an attached trim ring, all supported on a medium lamp base for screwing into a socket of a conventional, recessed can ceiling light fixture. The assembly shown in FIG. 4 is generally indicated by the numeral 110. Lamp 110 has a housing body 112 which houses an electronic circuit which includes a ballast. A conventional, screw-threaded, lamp base 114 is connected to one end of the housing body 112.

A socket 116 connected to the body 112 receives a commercially available push-in lamp 118.

A suitable lamp is a compact fluorescent lamp, for example, a 7-watt fluorescent lamp which has 400 initial lumens, and which is approximately equivalent to a 25-to-40 watt incandescent lamp, and which has a rated average life of 10,000 hours. Two such lamps 118 are used.

A reflector 120 is connected to the two lamp sockets 116. Reflector 120 has a large distal end 124 and a small proximal end 122, which has a ventilation opening 123 at its top for a chimney effect. Portion 126 of the smaller end 122 of reflector 120 is connected to the lamp sockets 116 by suitable fastening means, for example, spot welds or rivets 128. Similar rivets or spot welds 129 connect the lamp sockets 116 to the electronic ballast housing 112. The large end 124 of reflector 120 receives a fresnel lens 130. Holes 131 around the perimeter of the lens cooperate with the chimney opening 123 in the top of the reflector to provide air flow to prevent heat buildup within the reflector and to direct air flow around the ballast housing.

Lens 130 is held within receiver 132 integrally formed at the large end 124 of the reflector. The receiver 132 has a generally radially extending wall 134 and a generally axially extending cylindrical wall 136. Radially inwardly extending detects or bumps 138 hold lens 130 within the receiver.

Integrally formed trim ring 140 has its inner edge 142 connected to the outward extremity of the receiver wall 136. The receiver 140 is curved outwardly and rearwardly and terminates in a rolled edge 144, which abuts the ceiling when the lamp 110 is screwed into a socket of a recessed can fixture, such as shown in FIG. 2.

Each of the small, 7-watt lamps 118 has a base 150 which plugs into socket 116. An aluminum cap 152 covers a starter. Two electrical pins 154 are provided on opposite sides of a housing 156 which holds a capacitor. Lugs 158 which extend from opposite sides of housing 156 are engaged in notches 160 in sockets 116. Two wires 162 leading from each socket have connectors 164 which are fixed in sockets 116. Wires 162 are connected to a ballast within housing 112, and further wires connect the ballast to the conventional contacts of medium lamp base 114.

When one or both of the lamps 118 no longer provide light after several years of use, lamp 110 may be removed by placing fingernails under edge 144 of trim ring 140 and turning lamp 110 with trim ring 140 to unscrew lamp base 114 from its socket within the recessed can fixture. Lamps 118 may then be pushed from sockets 116 by inserting a tool through a hole (not shown) at the top of each socket 116 to force lugs 158 from their retaining notches 160. Alternatively, the entire lamp 110 may be replaced.

In a preferred method of replacing the lamps, the fresnel lens 130 is removed from the receiver 132 at the base of the reflector 120, and the darkened lamp 118 is pulled from its receptacle. Lugs 158 slide easily out of notches 160 when the lamp is pulled. A new lamp 118 is inserted, and the fresnel lens is replaced, completing the maintenance in a short time.

In a preferred embodiment of the invention, the fresnel lens 130 has notches around its perimeter at equal spacings with bumps 138. The perimeter notches in the fresnel lens 130 are aligned with bumps 138, and the lens is pressed upward and turned slightly to misalign the notches and prevent lowering of the fresnel lens. Removing the fresnel lens is as simple as twisting the lens to align the notches with the bumps.

In preferred embodiments of the invention, the ballast within housing 112 may be an electronic ballast or a magnetic ballast, either of which is potted within the housing. Air circulating upward through holes 131 in the lens and opening 123 in the reflector flows past the ballast housing, preventing temperature buildup from occurring around the ballast housing, as well as preventing temperature buildup within the reflector. The upward flowing air also has the advantage of keeping the lamp area clean.

In a preferred embodiment of the invention, the fresnel lens is constructed with a focal length of about 2½ or 3 inches, which is roughly the distance between the crossing point of the lamps 118 and the fresnel lens. Maximum illumination is generated around the crossing of the lamps, and the focal length of the fresnel lens is selected to take advantage of the maximum illumination locus. In a preferred embodiment, the fresnel lens has circular grooves. In one example of a useful lens, there may be approximately 100 grooves per inch. As is well known, the fine grooves are cut with angles which redirect the bright beams downward.

As shown in FIGS. 3 and 4, the preferred embodiment of the invention replaces conventional lamps used in recessed-can, ceiling lighting fixtures with lamp assemblies having reflectors with integral trim rings. The lamp assemblies are screwed into sockets in the ceiling fixtures, and the trim rings are held against the ceiling by virtue of upward tension on the sockets in which the lamp assemblies are mounted. Lamps 118 are long-lasting but may be easily and quickly replaced when necessary simply by removing the fresnel lens, pulling one lamp 118 from the socket 116 and placing a fresh lamp in the small socket.

While the invention has been described with reference to a specific embodiment, modifications and variations may be constructed without departing from the scope of the invention. The scope of the invention is defined in the following claims.

We claim:

1. An apparatus for use in a fluorescent lamp assembly having a fluorescent lamp, a ballast housing and a screw connector for connecting to a conventional screw socket on a support in a recessed can fixture mounted in a ceiling opening, said apparatus comprising:

means defining a reflector, a trim ring means and a ballast housing connecting means, said reflector having a first small end and a second large end, said ballast housing connecting means for connecting the first small end of the reflector to the ballast housing, said trim ring means extending generally radially outward from the second large end of the reflector and extending generally towards said screw connector, said trim ring means for being drawn aganist said ceiling opening when the screw connector is screwed into said socket concealing said ceiling opening.

2. The apparatus of claim 1 wherein the ballast housing connecting means comprises an inward curved axial extension on the small end of the reflector for tightly surrounding said ballast housing and extending in the direction of said screw connector and inward retainer means on the reflector near the small end for capturing the ballast housing near the fluorescent lamp.

3. The apparatus of claim 1 wherein said defining means further defines an outward extending recess at the large end, the recess having a wall extending radially outward from the large end and having a second cylindrical wall extending generally axially outward from the radially extending wall and means connected to the axially extending wall for retaining a lens, said apparatus further comprising a lens retained by said retaining means.

4. The method of mounting a fluorscent lamp apparatus in a recessed can fixture mounted in a ceiling opening comprising the steps of:

adjusting a socket height of a cantilevered socket, contacting a threaded base connector of said lamp apparatus with the socket, turning said lamp apparatus by grasping a trim ring of the lamp apparatus and turning the trim ring until the threaded base connector is sufficiently deep within the socket to illuminate the lamp apparatus, said turning step includes pulling of the trim ring by the cantilevered socket into contact with a ceiling surface surrounding the recessed can fixture and the ceiling opening and leveling the lamp apparatus allowing maximum use of the opening for the downward projection of light.

5. A lamp apparatus for connecting to a conventional screw socket on a resilient support in a recessed can fixture mounted in a ceiling opening, said lamp apparatus comprising:

a male threaded lamp base for screwing into said socket, a body connected to the lamp base, a light source connected to the body for producing light when the lamp base is screwed into said socket, means defining a reflector and a trim ring means, said reflector connected to the body and extending from the body around the light source in a direction opposite the lamp base, said reflector having a first small end connected to the body and a second larger end remote from the body, said trim ring means extending generally outwardly from the larger end, said trim ring means for being drawn against said ceiling opening when the lamp base is screwed into said socket concealing said ceiling opening.

6. The apparatus of claim 5 in combination with a recessed can for mounting in a ceiling having a generally cylindrical wall, a closure for closing a first inner end of the wall, a second end of the wall being configured for opening adjacent a hole in a ceiling, resilient means mounted in the recessed can adjacent the closure, a socket connected to the resilient means in a center of the can and an electrical conduit connected to the socket and extending outward through the recessed can, whereby when the lamp base is connected to the socket the resilient means pulls the lamp base, body and reflector inward in the can with the trim ring means covering the second end of the recessed can and abutting an area of a ceiling surrounding the can.

7. The apparatus of claim 5 wherein the light source conprises plural lamps mounted within the reflector.

8. The apparatus of claim 5 wherein the light source comprises a socket connected to the body for receiving a lamp and a lamp insertable in the socket and extending from the socket into the reflector for producing light within the reflector.

9. The lamp apparatus of claim 5 wherein said defining means further comprises means in the larger end of the reflector for mounting a lens, said lamp apparatus further comprising a lens mounted in said mounting means enclosing the light source within the body, reflector and lens.

10. The apparatus of claim 9 further comprising a ballast mounted in the body and electrically connected between the lamp base and the light source.

11. The lamp apparatus of claim 5 wherein the light source further comprises secondary sockets connected to the body and to the reflector and extending outward therefrom and secondary lamps having secondary bases connected to the secondary sockets and the secondary lamps extending into the reflector for producing light within the reflector.

12. The lamp apparatus of claim 11 wherein the reflector is connected to the body via the secondary sockets.

13. A lamp apparatus for connecting to a conventional screw socket on a support in a recessed can fixture mounted in a ceiling opening, said lamp apparatus comprising:

a screw connector for connecting to said conventional screw socket, a ballast housing near the screw connector, a fluorescent lamp ballast mounted within the ballast housing, a fluorescent lamp connected to the ballast and extending in a direction opposite the screw connector, means defining a reflector, a trim ring means, and a ballast housing connecting means, said reflector having a first small end and a second large end, said ballast housing connecting means connecting the first small end of the reflector to the ballast housing near the fluorescent lamp, said trim ring means extending generally radially outward from the second large end of the reflector and extending generally towards said screw connector, said trim ring means for being drawn against said ceiling opening when the screw connector is screwed into said socket concealing said ceiling opening.

14. The apparatus of claim 13 wherein said ballast housing connecting means comprises an inwardly curved axial extension extending axially from the first small end toward the screw connector, and inward extending detents in the first small end of the reflector, whereby the detents fit over the ballast housing and snap the reflector into place on the ballast housing with the inwardly curved axial extension tightly overlying a portion of the ballast housing adjacent the fluorescent lamp and remote from the screw connector.

15. The apparatus of claim 13 wherein said defining means further defines a radially outwardly extended stepped recess at the second large end of the reflector between the second large end and the trim ring means and means in the stepped recess for retaining a lens, said apparatus further comprising a lens retained by said retaining means.

16. The apparatus of claim 15 wherein the means for retaining the lens comprise inward extending beads on a wall of the stepped recess for retaining the lens between the beads and a radially outward extending shoulder of the recess.

17. A lamp apparatus for connecting to a conventional screw socket on a support in a recessed can fixture mounted in a ceiling opening, said lamp apparatus comprising:

a threaded screw base connector, a ballast housing connected to the threaded screw base connector, plural lamp sockets connected to the ballast housing, plural lamps severally mounted in the plural sockets, electrical conductive means connected to the threaded base connector and to the ballast housing and to the lamp sockets for providing electrical energy to the lamps mounted within the lamp sockets, and means defining a reflector and a trim ring means, said reflector connected to the ballast housing and having a first end near the ballast housing and a second end remote from the ballast housing, said trim ring means extending generally radially outward from the second end of the reflector and extending generally towards said base connector, said trim ring means for being drawn against said ceiling opening when the base connector is screwed into said conventional screw socket concealing said ceiling opening.

18. The lamp apparatus of claim 17 wherein the reflector is a curved reflector having a focal point and wherein the lamps are elongated tubes and wherein the sockets are positioned on the reflector so that the lamps cross at a point near the second end of the reflector.

19. The lamp apparatus of claim 17 wherein the reflector is connected to the ballast housing via the lamp sockets.

20. The lamp apparatus of claim 17 wherein the defining means further defines a recess surrounding the reflector second end and wherein the lamp apparatus further comprises a lens mounted within the recess.

* * * * *